US006299112B1

(12) United States Patent
Suk

(10) Patent No.: US 6,299,112 B1
(45) Date of Patent: Oct. 9, 2001

(54) GOLF BAG LEG OPENING MECHANISM WITH A MECHANICAL ADVANTAGE

(76) Inventor: Young Suk, 270 Glen Cove Ave., Sea Cliff, NY (US) 11579

( * ) Notice: Subject to any disclaimer, the term of this patent is extended or adjusted under 35 U.S.C. 154(b) by 0 days.

(21) Appl. No.: 09/495,372

(22) Filed: Feb. 1, 2000

(51) Int. Cl.[7] ..... A63B 55/00
(52) U.S. Cl. ..... 248/96; 206/315.7
(58) Field of Search ..... 248/96, 168, 169, 248/188.3, 688; 206/315.7, 315.8, 315.3

(56) References Cited

U.S. PATENT DOCUMENTS 5,549,263 * 8/1996 Maeng ..... 248/96
5,597,144 * 1/1997 Lee ..... 248/96
5,634,616 6/1997 Wong .
5,718,401 * 2/1998 Walters ..... 248/96
5,829,719 * 11/1998 Han ..... 248/96
5,860,521 * 1/1999 Wu ..... 206/315.7
6,062,383 * 1/1999 Han ..... 206/315.7

* cited by examiner

*Primary Examiner*—Ramon O. Ramirez
*Assistant Examiner*—Tan Le
(74) *Attorney, Agent, or Firm*—Myron Amer PC

(57) ABSTRACT

A tripod leg support for a golf in the operation of which pivotal traverses of cranks project the legs into open positions in response to the ascending movement of wires connected to the cranks, wherein the path of ascending wire movement is tangential to the pivotal traverse of the cranks, to thereby contribute to a maximum mechanical advantage in the opening of the legs.

1 Claim, 3 Drawing Sheets

GOLF BAG LEG OPENING MECHANISM WITH A MECHANICAL ADVANTAGE

The present invention relates generally to an improved leg mechanism attachment to a golf bag, the leg mechanism improvement more particularly contributing to greater ease and effort in using the leg mechanism to provide a tripod support for the golf bag.

EXAMPLE OF THE PRIOR ART

It is well documented in the patented literature that playing golf is greatly facilitated if the golf bag containing the golf clubs not in use is supported in an upright condition while the golfer is using the golf club selected from the golf bag appropriate for the golf shot at hand. The prior art support of choice is one assuming a tripod configuration in which left and right legs are urged through pivotal traverses into angular positions which are effective to steady the golf bag positioned therebetweeen.

Exemplifying the patent literature is U.S. Pat. No. 5,634,616 for "Removable Automatic Tripod Legs For Golf Bags" issued to Wang et al. on Jun. 3, 1997. In the '616 patent and all other known patents, the leg-opening mechanism uses cranks operated by a wire spring which, in response to ground contact, causes a rotation of the cranks which, in turn, impart corresponding rotational traverses to the legs. To this end, the spring has a Y-shape and each upper leg of the Y is attached to a cooperating crank, while the bottom leg is used to make ground contact and impart an ascending movement to the spring. While generally useful for the purposes intended, the operational mode as just generally described of the prior art leg mechanism do not operate with optimum case and effort, as can be verified by the upper Y-shape legs manifesting a noticeable bow configuration between their attachment to the cranks and to their extension from the bottom ground-engaging leg. Stated somewhat differently, the force producing the bending of the upper legs of the spring is better used in rotating the cranks, and this is not achieved in the prior art legopening mechanisms.

Broadly, it is an object of the present invention to provide a golf bag tripod support overcoming the foregoing and other shortcomings of the prior art.

More particularly, it is an object to provide a golf bag leg-opening construction which has a leg-opening operating mode which is implemented with a mechanical advantage, to thereby contribute to greater ease and optimum minimum effort in its use.

The description of the invention which follows, together with the accompanying drawings should not be construed as limiting the invention to the example shown and described, because those skilled in the art to which this invention appertains will be able to devise other forms thereof within the ambient of the appended claims.

FIGS. 2–7 illustrate leg supports embodying the present invention in which FIG. 2 is a rear elevational view of the leg supports in a closed condition on the rear of a golf bag shown in phantom perspective;

FIG. 3 is a perspective view illustrating the leg supports in an open condition;

FIG. 4 is a side elevational view projected from FIG. 2,

FIG. 5 is similarly side elevation view but projected from FIG. 3;

FIG. 6 is an isolated partial view, on an enlarged scale, of the positioning cranks means of the leg supports; and;

FIG. 7 is an isolated partial view, on an enlarged scale, of ground-engaging means for urging the crank means in pivotal traverses.

Figure 1:
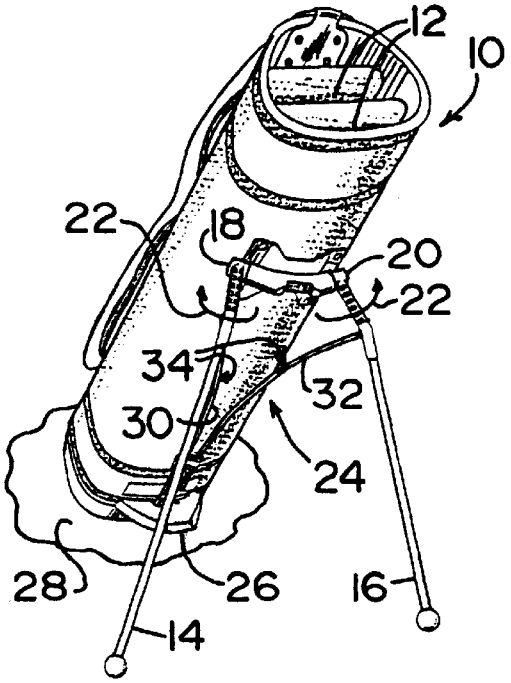
FIG. 1 PRIOR ART
FIG. 1 is perspective view of a golf bag with prior art leg supports.

As known from general experience, as well as from illustrations and descriptions in numerous prior patents, the playing of golf is greatly facilitated if the golf bag 10 having golf club storage compartments 12 (golf clubs not shown) have left 14 and right 16 support legs which are cranked, as at pivots 18 and 20, into an open condition, as illustrated in FIG. 1, to steady the golf bag 10 positioned therebetween, wherein the golf bag 10 and left leg 14 and right leg 16 form a tripod support. Among the prior patents disclosing the noted tripod support is U.S. Pat. No. 5,634,616 for "Removable Automatic Tripod Legs For Golf Bags" issued to Wing et al. On Jun. 3, 1997, as can best be understood from FIG. 1. The legs 14 and 16 are urged in rotational movement 22 about the respective pivots 18 and 20 by a spring 24 of springy construction material having a ground-engaging bottom member 26 which, in response to being pressed into the ground 28 causes ascending movement in arms 30 and 32 connected to the legs 14 and 16, which legs are in turn connected to the crank pivots 18 and 20. In the '616 patent spring 24, and in all other similar crank-operated springs, there is a loss of mechanical advantage which manifests itself by significant bending, as at 34, in the spring arms 30, 32, the bending being part of the applied force of the bottom member 26 that should instead be directly effective in producing the rotational movements 22.

Method aspects of the present invention are concerned with an urging of the golf bag support legs in their pivotal traverse with a significantly increased mechanical advantage, all as will be better understood as the description proceeds.

Affixed adjacent a top of the rear of a golf bag 40 is a plastic mounting plate 42, appropriately secured as at the locations, individually and collectively designated 44, to which there is integrally molded cylindrical hubs 46 and 48 having blind drilled holes 50 and 52 therein, sized to receive in projected relation cylindrical inward axial projections 54 and 56 from the distal ends, as at 58 and 60, of cranks 62 and 64, such that the cranks 62 and 64 are journal led for rotation in the hubs 46 and 48.

Figure 4:
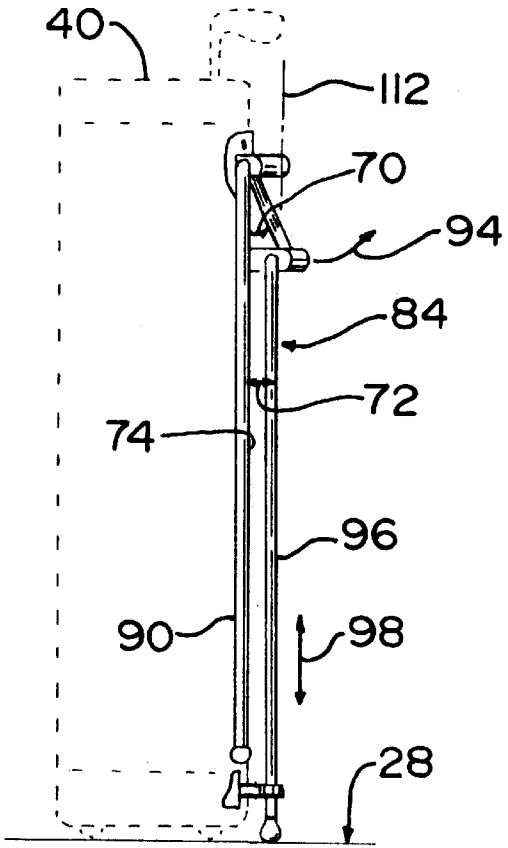
Figure 7:
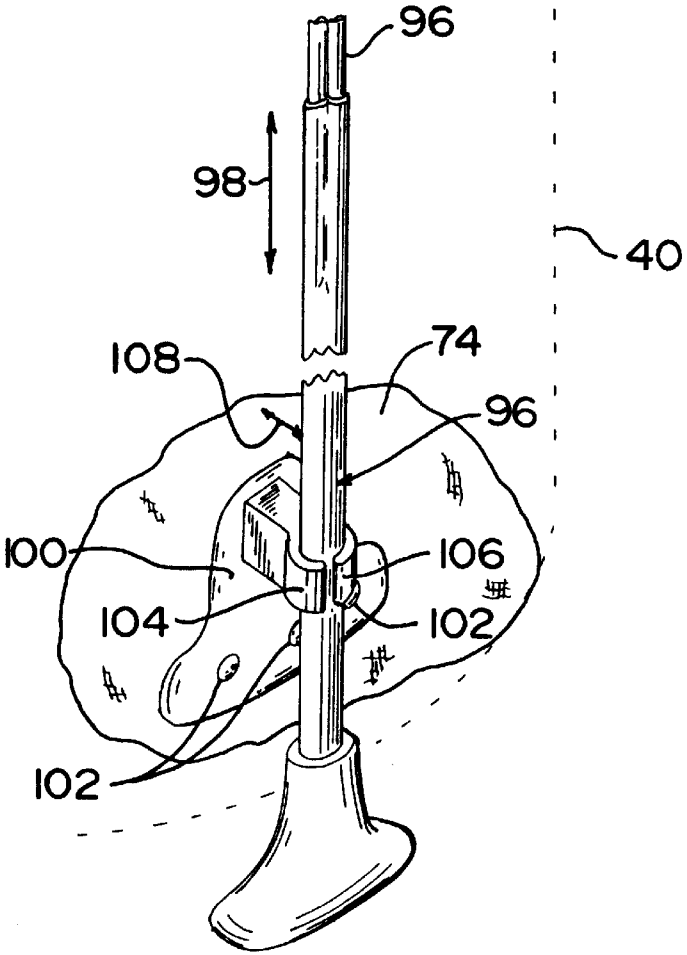

The cranks 62 and 64 each have a proximal end, as noted at 66 and 68, and each extends at an angular orientation 70 (see FIG. 4) which positions each crank proximal end in a position of clearance, as at 72, beyond the rear surface 74 of the golf bag 40. Attached to each proximal end 66, 68 of the cranks 62, 64, in any appropriate manner, such as by being inserted through bores 76, 78, are the upper arms 80 and 82, of a spring 84, as best shown in FIG. 6.

Figure 2:
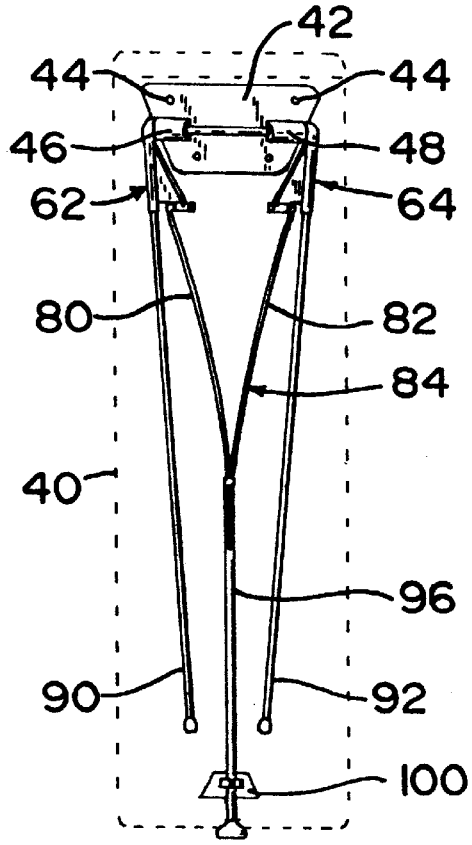
Figure 3:
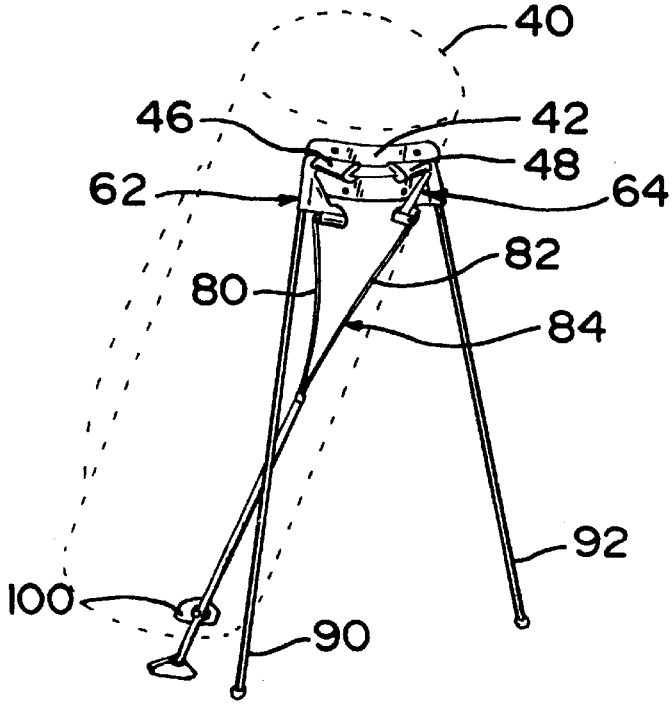
Figure 5:
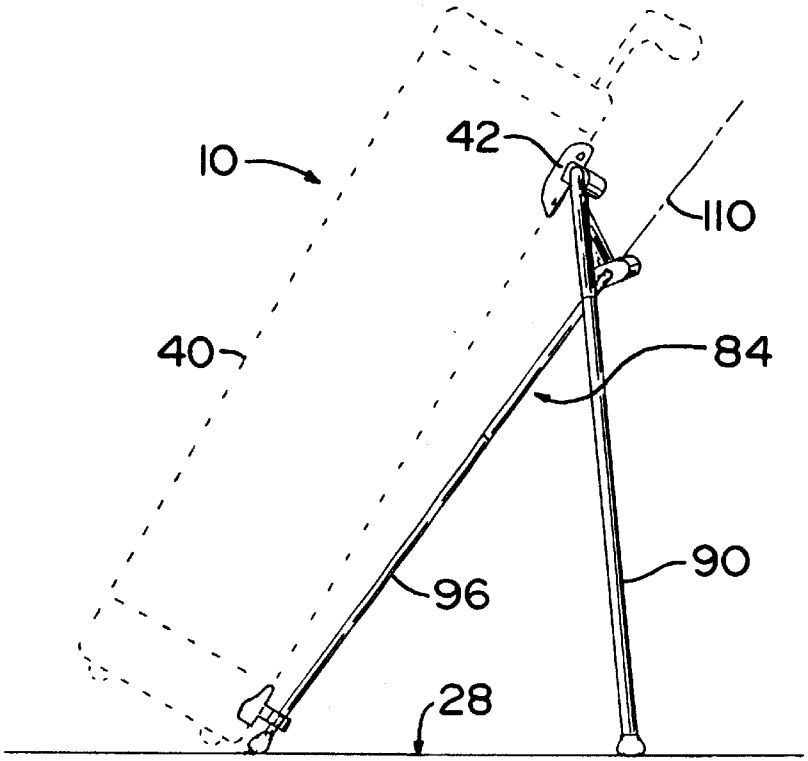
Figure 6:
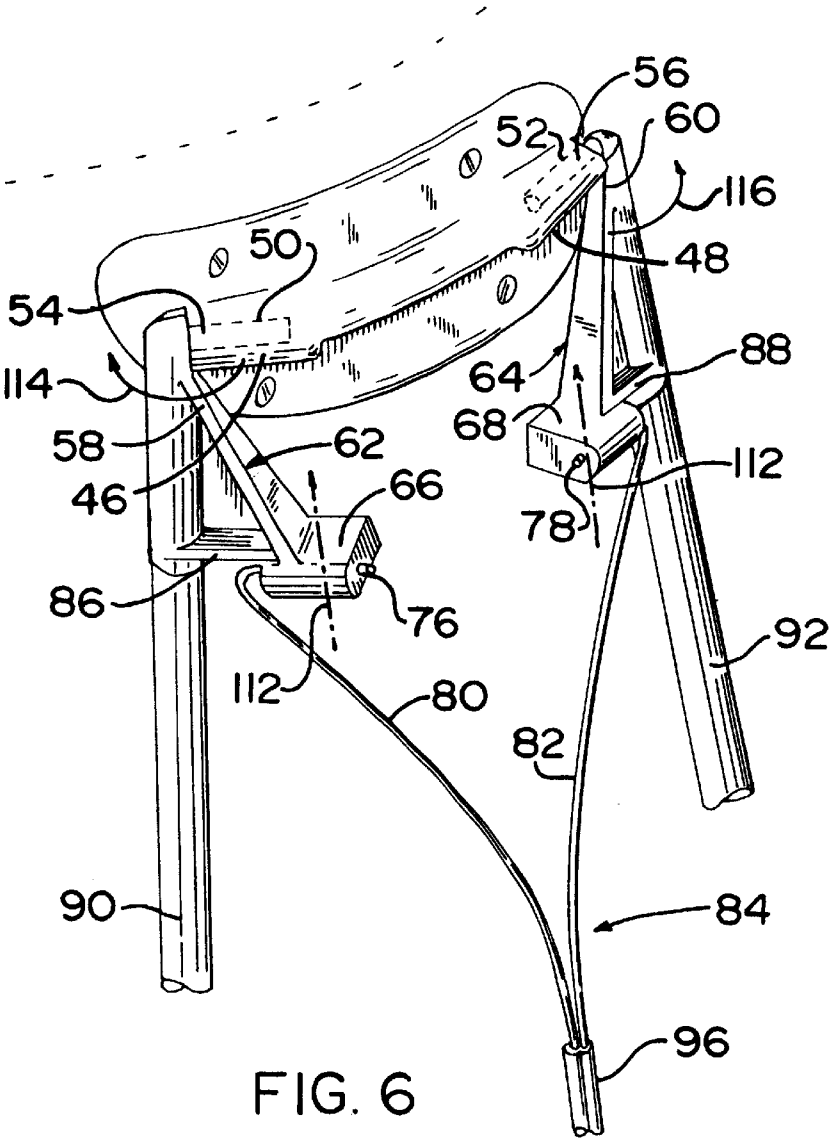

Completing the support leg construction as best understood from FIG. 6, are molded connections 86 and 88 between the cranks 62, 64 and the support legs 90, 92, so that rotational movements 94 in the cranks 62, 64 are imparted to the legs 90, 92 and produce the closed (FIGS. 2, 4) and open (FIGS. 3, 5) positions of the support legs 90, 92.

In accordance with the present invention the noted positions of movement of the support legs 90, 92 are achieved with maximum mechanical advantage which is readily discernible by the absence of the bending in the spring arms 80 and 82 that is characteristic of the prior art spring 24 of FIG. 1.

The increased mechanical advantage is achieved, in a preferred embodiment, by positioning a bottom length portion 96 of the spring 84 for opposite direction sliding movement 98 in a bracket 100 riveted as at the plural locations 102 to the bottom of the golf bag 40 and having a laterally extending cooperating semi-circular spring-engaging grips 104, 106, the dimension 108 of the lateral extension being approximately equal to the clearance 72 of the cranks 62, 64 rearwardly of the golf bag 40. As a result of the correlation of the clearance 72 and the crank laterally extending distance 108, the spring 84 is oriented in a plane 110 which is tangential, as noted at 112, to the rotational crank movements 114, 116, to thereby contribute to avoiding out-of-plane bending in the spring arms 80, 82 and instead achieving maximum mechanical advantage in the opening and closing of the legs 90, 92. As a result, during the playing of golf, there is greater ease and effort required to achieve a tripod support for the golf bag and golf clubs cared in the golf bag, which for a typical golfer scoring a round of 95 strokes, for example, the golfer would be required to set up the tripod support approximately 95 times and thus the greater ease and effort in doing so is of significant utility.

While the apparatus for practicing the within inventive method, as well as said method herein shown and disclosed in detail is full capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. In providing tripod support for a golf bag during which left and right support legs are cranked into opened positions to steady said golf bag positioned therebetween, the improvement consisting of a method of urging said support legs in a pivotal traverse with an increased mechanical advantage comprising the steps of:

a. using for each support leg a crank having a distal end and a proximal end;

b. operatively disposing a crank with said distal end pivotally mounted adjacent a top of said golf bag and said proximal end in an angular orientation and in a clearance position from said golf bag top;

c. attaching each said support leg to a cooperating crank distal end so as to impart a rotational traverse of said crank distal end to said support leg;

d. using a Y-shaped spring of springy wire construction material having left and right arms with a depending length portion providing a ground-engaging bottom effective to impart a rotational traverse degree of movement;

e. attaching an upper end of each arm of said Y-shaped spring to a cooperatively each said crank proximal end and having said ground-engaging length portion extending in parallel relation to said golf bag; and f. holding said ground-engaging bottom of said Y-shaped spring in a clearance position from said golf bag of a same extent as said clearance position of said crank proximal ends so that an ascending path of movement of said Y-shaped spring is approximately tangential to said rotational traverses of said cranks;

whereby grounding of said bottom of said Y-shaped spring causes ascending movement thereof along said tangential path to maximize an applied mechanical advantage and to obviate any bending out of plane of said arms of said Y-shaped spring.

* * * * *